US005590443A

United States Patent [19]

Fildan

[11] Patent Number: 5,590,443

[45] Date of Patent: Jan. 7, 1997

[54] NONSLIP SLIDE BUCKLE

[76] Inventor: Gerhard Fildan, Wohnpark Alte Erlaa, Anton-Baumgartner Str. 44, C 2 21 01, A-1232 Vienna, Austria

[21] Appl. No.: 455,274

[22] Filed: May 31, 1995

[51] Int. Cl.[6] ..... A44B 11/02

[52] U.S. Cl. ..... 24/200; 24/196; 24/197

[58] Field of Search ..... 24/197, 196, 200

[56] References Cited

U.S. PATENT DOCUMENTS

| | | | |
|---|---|---|---|
| 1,188,206 | 6/1916 | Robinson | 24/197 |
| 1,400,178 | 12/1921 | Perrine | 24/200 |
| 1,648,017 | 11/1927 | Jenkins | 24/197 |
| 1,695,056 | 12/1928 | Mosgrove | 24/200 |
| 1,836,923 | 12/1931 | Hodge | 24/196 |
| 1,844,274 | 2/1932 | Domkee | 24/200 |
| 1,873,371 | 8/1932 | Ford | 24/196 |
| 1,887,096 | 11/1932 | Hodge | 24/196 |
| 2,649,637 | 8/1953 | Hodge | 24/200 |
| 3,760,466 | 9/1973 | Leblanc | 24/200 |

FOREIGN PATENT DOCUMENTS

| | | | |
|---|---|---|---|
| 502274 | 3/1939 | United Kingdom | 24/200 |

*Primary Examiner*—Peter M. Cuomo
*Assistant Examiner*—Stephen Vu
*Attorney, Agent, or Firm*—Herbert Dubno; Yuri Kateshov

[57] ABSTRACT

A nonslip slide or buckle has elongated teeth projecting along edges of openings defined between the outer limbs and the central limb and through which straps are looped for lingerie or corsetry, thereby preventing slippage of the buckle relative to the straps or vice versa without allowing snagging of outer garment fabrics.

7 Claims, 3 Drawing Sheets

NONSLIP SLIDE BUCKLE

FIELD OF THE INVENTION

My present invention relates to a nonslip slide or buckle, especially for lingerie and corsetry and particularly to a slide which is intended to be worn as part of an undergarment below a blouse or other outer garment which might be sensitive to the presence of teeth on a buckle or the like.

BACKGROUND OF THE INVENTION

In lingerie and corsetry, slides, buckles and other fasteners are provided between loops of straps and the like on undergarments intended to be worn below outer garments such as blouses which may be composed of delicate material like silk and are sensitive to catching on sharp edges or points, or are readily damaged by mechanical structures.

In such cases the problem of damage to an outer garment by the buckle or slide of an undergarment or of irritation to the user can be significant, especially if the buckle or slide is provided with formations, for example, teeth, which are intended to grip the strap or straps and thus prevent or limit slippage.

While relatively complicated constructions have been developed in an effort to avoid problems with delicate fabrics of the undergarment or outer garment, there is still a serious problem in the field of lingerie and corsetry to restrict the slippage of the strap loops and/or damage to delicate fabrics of the outer garments or of the undergarments themselves.

OBJECTS OF THE INVENTION

It is, therefore, the principal object of the present invention to provide a nonslip slide or buckle, especially one which is adapted to connect two straps of lingerie or corsetry, which is free from the above-mentioned drawbacks of prior art systems.

Another object of the invention is to provide a nonslip slide or buckle which is self-gripping with respect to straps, looped through it but which nevertheless will not mar or catch on a delicate fabric of an outer garment.

Still another object is to provide a buckle or slide which is free from drawbacks of earlier slides used in lingerie and corsetry.

SUMMARY OF THE INVENTION

These objects and others which will become apparent hereinafter are attained, in accordance with the invention in a nonslip slide or buckle which comprises:

a one-piece planar frame body formed with a pair of mutually parallel outer limbs, a central limb parallel to the outer limbs and disposed between them, a respective pair of bows connecting each of the outer limbs with the central limb, and a pair of elongated openings formed on opposite sides of the central limb and each defined by a respective outer limb, a respective pair of the bows and the central limb, whereby garment straps to be connected by the buckle pass through the openings and are looped around the outer limbs, each of the outer limbs being formed along an edge thereof adjoining a respective one of the openings with an elongated tooth on at least one side of the frame body, extending along the respective edge and projecting out of a plane of the body, each of the teeth having a length of at least one quarter a length of the respective outer limb.

According to a feature of the invention, on each of the sides of the frame body, each of the outer limbs or bars is provided, adjoining the respective elongated opening, with two such elongated teeth which can be spaced-apart preferably by a distance less than half of a tooth length, all of the teeth being of the same length.

The teeth can have sharp edges defined between flanks including acute angles with one another. An edge to edge width measured between corresponding teeth on opposite sides of the slide body can exceed a thickness of the body measured transverse to the plane. These flanks can include flanks bounding the openings forming acute angles of 1° to 15° with a perpendicular to the plane, preferably 8°. The flanks defining the edges can include other flanks extending at obtuse angles to sides of the body parallel to the plane and themselves including angles of 40° to 50° with the aforementioned perpendicular to the plane.

According to a further feature of the invention the central limb has a greater thickness than the outer limbs measured perpendicular to the plane and the outer limbs can be provided with beveled outer flanks. In practice, the slide or buckle, upon use, i.e. having straps looped around the outer limbs through the respective opening, cannot snag on even very delicate fabrics of outer garments because the long teeth are completely shielded by the loops but nevertheless engage the straps of the loops over large line lengths and are effective, therefore, in a self-tightening manner to lock against slippage relative to the straps. There is no danger that the elongated teeth will pierce the straps and further, because of the substantial contact length of the teeth with the straps, the fastener has been found to be effective even with straps composed of relatively slippery material including straps which have shiny and very smooth surface textures.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
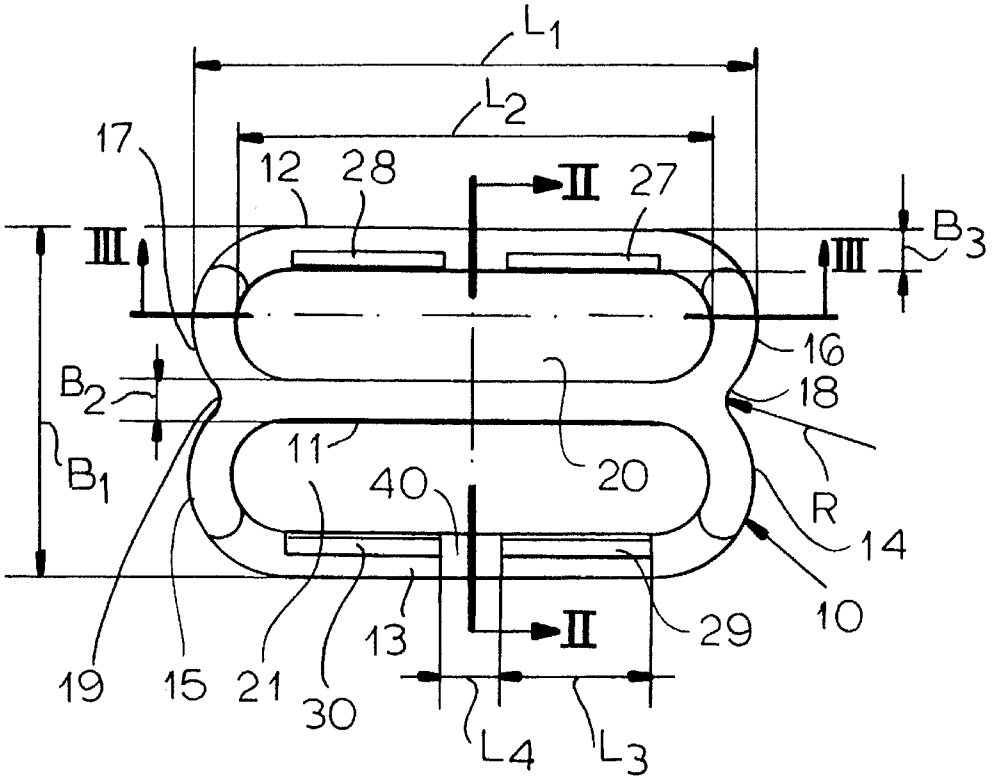
FIG. 1 is an elevational view of a nonslip slide or buckle according to the invention.

In FIG. 1 I have shown a nonslip slide or buckle 10 which is molded in one piece from synthetic resin and, as is apparent from FIG. 1, comprises a central bar or limb 11 and a pair of outer bars or limbs 12 and 13 connected to the central limb 11 by respective pairs of bows 14, 15 and 16, 17. The body is indented at 18 and 19 with a radius R of, preferably, 0.50 mm±25%.

The frame body 10 also is formed with a pair of elongated openings 20 and 21 each defined between the central limb 11 and the respective outer limb 12, 13, between the bows of the respective pair.

Figure 2:
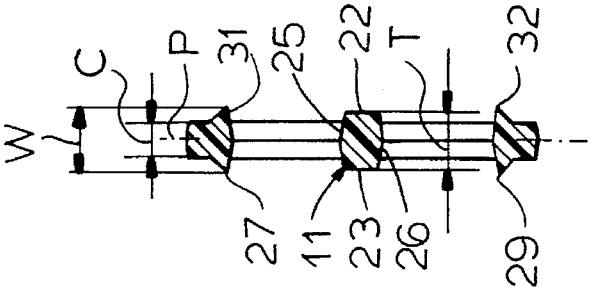
FIG. 2 is a section taken along the line II—II of FIG. 1.

Turning to FIG. 2, it will be seen that the buckle or slide lies generally in a plane P and has sides 22 and 23 parallel to the plane P separated by a thickness T which may amount to 1.8 mm±0.4 mm. The inner and outer flanks 25 and 26 of the central bar 11 may be beveled as shown in FIG. 2.

Important to the present invention is that the outer limbs 12 and 13 each have a maximum of two teeth extending over a major part of the length of the respective outer limb. In FIG. 1, for example, there are two teeth on each limb as represented at 27, 28, 29 and 30 on the side of the buckle visible in FIG. 1. Corresponding teeth are provided, e.g. at 31 and 32 on the opposite side of the slide or buckle.

Figure 4:
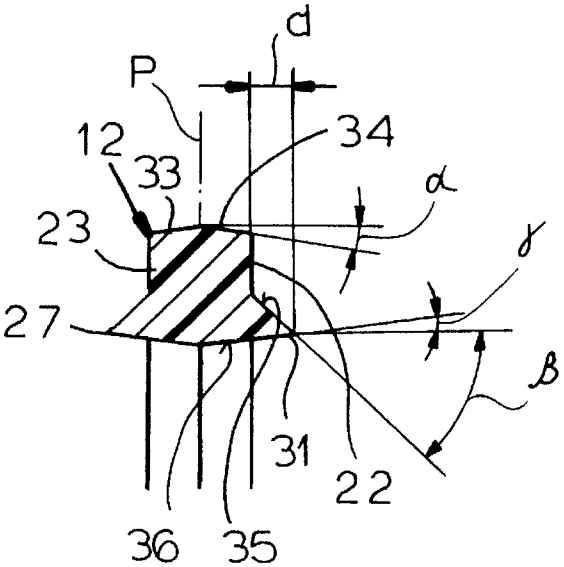
FIG. 4 is a detail section to a larger scale through one of the outer limbs.

The tooth structure is shown in detail for the teeth 27 and 31 in FIG. 4. From this Figure it will be apparent that the outer limb 12 can have beveled flanks 33 and 34 at its back side, inclined with respect to the plane P and preferably such that these flanks include angles $\alpha$ of, say 8°±2° with a perpendicular to the plane P. The outer limbs 12 and 13 are of reduced thickness t (FIG. 2), say 1.20 mm±0.15 mm while the edge to edge width of the teeth 27, 31 represented at w can amount to 2.20 mm±25% and is equal to or just slightly greater than the thickness T. Preferably the teeth 27, 31, etc. project beyond the planes of the sides 22 and 23 by about 0.2 mm±0.1 mm. The teeth 27, 31, etc. should project beyond the sides 22 and 23 by a distance d of about 0.5 mm, ±25%.

As is also apparent from FIG. 4, each of the teeth 27, 31 ff is defined between a flank 35 forming an obtuse angle with the respective side, e.g. 22, and including an acute angle $\beta$ between 40° and 50° and preferably about 45° with the aforementioned perpendicular to the plane P.

The other flanks defining each edge is a flank 36 which bounds the respective opening 20, 21 and can be inclined to a perpendicular to the plane P at an angle $\gamma$ of 1° to 15° and preferably around 8°.

The thickness of the central bar 11 acts to stiffen the buckle and increase the bulge of the straps looped therearound.

While other dimensions are not critical, the buckle can accommodate straps ranging in width from ⅜ inch to 1 inch ($L_2$) with $L_1$ being approximately 20% larger, the overall breadth $B_3$ should be 12 mm±30%. The breadths $B_2$ of the central limb 11 and $B_3$ of the outer limbs 12 and 13 can be 1.20 to 2 mm and 1.45 mm±25%, respectively. The thickness t can correspond to $B_2$ As can be seen from FIG. 1, the tooth length $L_3$ should be greater than a quarter of the length of the outer limb 12 or 13 and the spacing 40 between the teeth should have a length $L_4$ which is less than half the tooth length.

Figure 3:
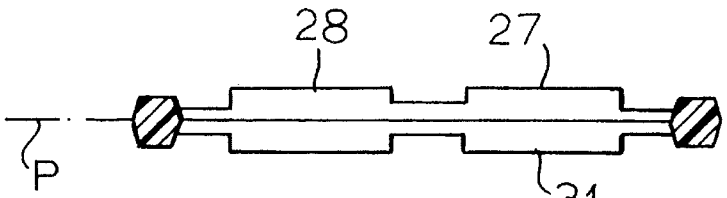
FIG. 3 is a section taken along the line III—III of FIG. 1.
Figure 6:
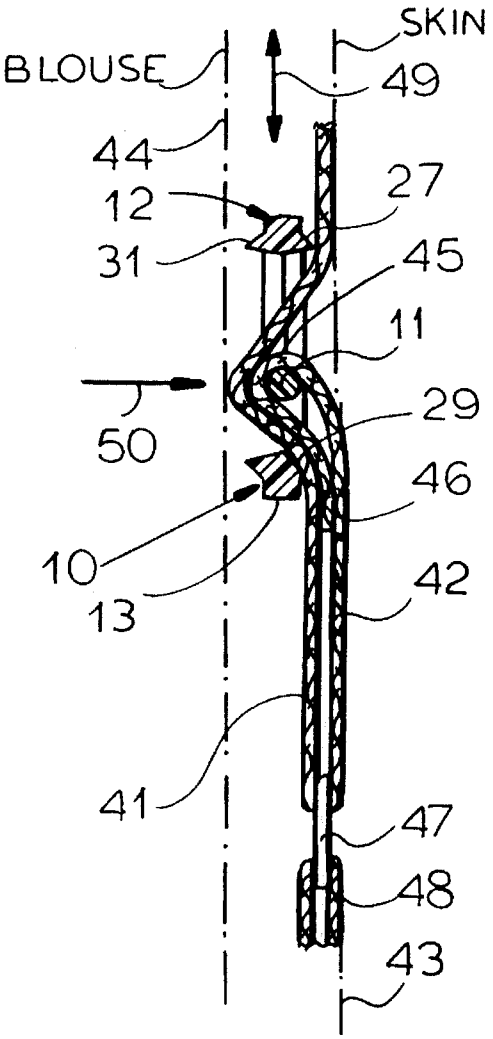
FIG. 6 is a cross section through the buckle or slide with the strap loops in place illustrating the principles of the invention.
Figure 5:
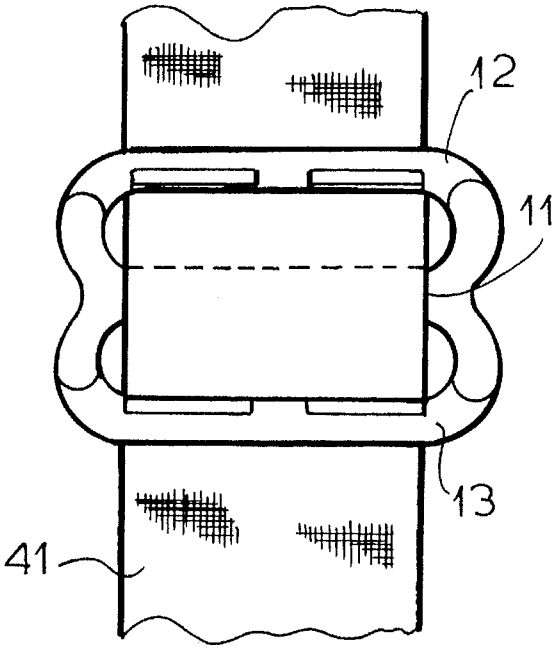
FIG. 5 is an elevational view showing the buckle or slide engaged by two strap loops.

In FIG. 3, the alignment of the teeth 27, 31, etc. on opposite sides of the plane P will be readily apparent. FIGS. 5 and 6 show the use of the slider or buckle of FIGS. 1–4 for adjustment of the effective length of a brassiere strap, for example, as can be seen from FIG. 6, one stretch 42 of a brassiere shoulder strap is provided with a loop 45 around the central limb 11, the free end 46 of that loop being stretched to the stretch 42 to complete the loop. The stretch 42 then passes around a link 47 to which a brassiere strap 48 is connected in the usual manner. The upwardly extending pass 41 of the shoulder strap then extends behind the slider 10 and the outer limb 13, around the loop 45 and the bar 11 and behind the outer limb 12. The slidable adjustment represented by the arrow 49 in FIG. 6 allows the effective length of the shoulder strap to be adjusted The teeth 27 and 29 on the skin side 43 can engage or snag the strap so that even in the case of smooth shiny straps, there is no danger of slippage, the slider 10 being drawn by the tension in the direction of arrow 50. The teeth 31 at the blouse side 43 of the slide or buckle do not snag in the blouse fabric. There is also no danger of piercing the strap because of the lengths of the teeth.

Figure 7:
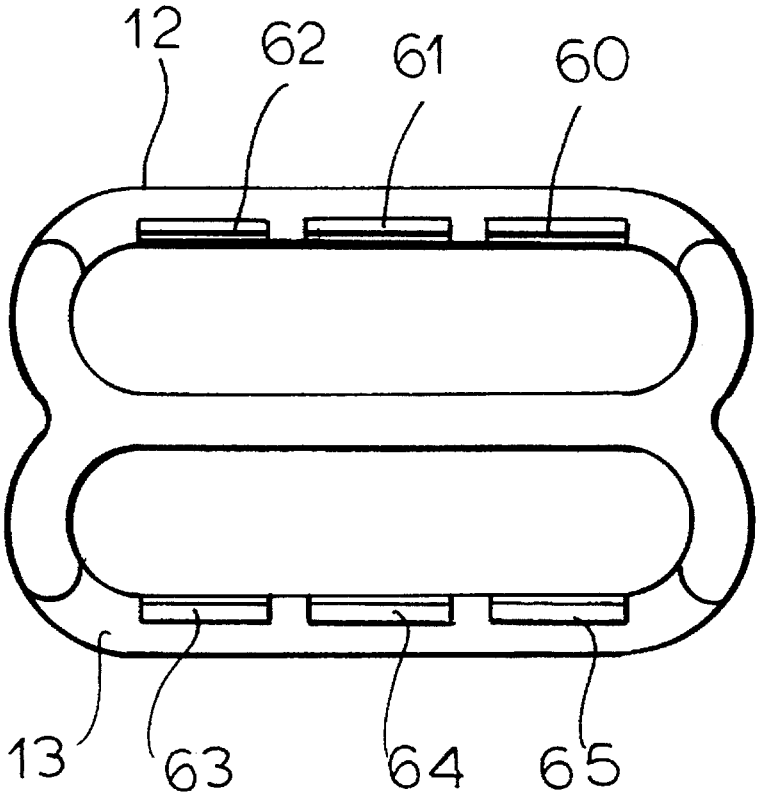
FIG. 7 is a view similar to FIG. 1 of another embodiment.

FIG. 7 shows the principle that, for longer slides, e.g. for a strap length of 1", the limbs 12 and 13 can be provided with three teeth 60–62 or 63–65 on each side along the respective inner edge. The teeth are otherwise similar to those described.

I claim:

1. A buckle for lingerie and corsetry, comprising:

a one-piece planar frame body formed with a pair of mutually parallel outer limbs, a central limb parallel to said outer limbs and disposed between them, a respective pair of bows connecting each of said outer limbs with said central limb, and a pair of elongated openings formed on opposite sides of said central limb and each defined by a respective outer limb, a respective pair of said bows and said central limb, whereby garment straps to be connected by said buckle pass through said openings and are looped around said outer limbs, each of said outer limbs being formed with an inner edge thereof adjoining a respective one of said openings and an outer edge, said edges being defined by a respective pair opposite sides of each outer limb; and at most three spaced apart elongated teeth formed along the respective inner edge and spaced from the respective outer edge, said teeth being formed on opposite sides of at least one of the outer limbs and projecting out of a plane of said body, each of said teeth being separated from an adjacent tooth by a respective gap and being formed with a respective pair of flanks converging toward one another, and a respective linear sharp ridge defined between the flanks and extending parallel to the inner edge of the respective outer limb.

2. The buckle defined in claim 1 wherein on each of said sides of said frame body each of said outer limbs is formed along the respective edge adjoining the respective opening with two of said elongated teeth spaced apart by a distance less than half of a length of said teeth.

3. The buckle defined in claim 2 wherein said flanks include acute angles with one another, a ridge-to-ridge width measured between ridges of corresponding teeth on opposite sides of said body exceeding a thickness of said body measured transverse to said plane.

4. The buckle defined in claim 3 wherein said flanks include flanks bounding said openings and forming acute angles of 1° to 15° with a perpendicular to said plane.

5. The buckle defined in claim 4 wherein said flanks include flanks extending at obtuse angles to sides of said body parallel to said plane and forming acute angles of 40° to 50° with a perpendicular to said plane.

6. The buckle defined in claim 5 wherein said central limb has a greater thickness than said outer limbs measured perpendicular to said plane.

7. The buckle defined in claim 6 wherein said outer limbs are provided with beveled outer flanks.

* * * * *